US006606882B1

(12) United States Patent
Gupte

(10) Patent No.: US 6,606,882 B1
(45) Date of Patent: Aug. 19, 2003

(54) FALLING FILM EVAPORATOR WITH A TWO-PHASE FLOW DISTRIBUTOR

(75) Inventor: Neelkanth Shridhar Gupte, Granger, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/278,265

(22) Filed: Oct. 23, 2002

(51) Int. Cl.[7] ..... A23C 3/04; F25B 39/02
(52) U.S. Cl. ..... 62/504; 165/115
(58) Field of Search ..... 62/504, 515, 525; 165/115, 117, 159, 172, 160, DIG. 163

(56) References Cited

U.S. PATENT DOCUMENTS 5,709,264 A * 1/1998 Sweeney et al. ..... 165/115
5,755,279 A * 5/1998 Sweeney et al. ..... 165/115
6,167,713 B1 * 1/2001 Hartfield et al. ..... 62/115

FOREIGN PATENT DOCUMENTS

JP 403134491 A * 6/1991 ..... 165/159

* cited by examiner

*Primary Examiner*—Melvin Jones
(74) *Attorney, Agent, or Firm*—Wall Marjama & Bilinski LLP

(57) ABSTRACT

A falling evaporator has a two-phase refrigerant flow distribution system with improved circulation features in both the header and subheader of the system. Both the header and the subheader have vertically disposed, parallel pass conduits interconnected by way of a return bend, with the downstream end of the second pass conduits then fluidly interconnected with the upstream end of the first pass conduits to complete the circuit. A nozzle at the upstream end of the first pass conduits provides a relatively high velocity jet stream of refrigerant flow that propels the flow of refrigerant around the circuit so as to prevent stratification. The header has a plurality of outlets formed in its wall to accommodate the flow of two-phase refrigerant to the various subheaders, and each subheader has openings formed in a lower wall of its first pass conduit such that refrigerant can flow from the openings, to the outer upper surface of the second pass conduits and eventually to the heat transfer tubes below.

17 Claims, 1 Drawing Sheet

FALLING FILM EVAPORATOR WITH A TWO-PHASE FLOW DISTRIBUTOR

FIELD OF THE INVENTION

This invention relates generally to air conditioning evaporators and, more particularly, to evaporators with two-phase refrigerant flow distribution.

BACKGROUND OF THE INVENTION

In the cooling phase of a refrigeration system the heat exchanger referred to as an evaporator receives liquid refrigerant by way of an expansion valve, with the expanding refrigerant then tending to cool the liquid being separately circulated through the evaporator. The fluid to be cooled carries the heat load which the air conditioner is designed to cool, with the evaporator then transferring heat from the heat load to the liquid refrigerant.

The fluid to be cooled may flow through the evaporator by way of a bundle of pipes having heat conductive walls, with the liquid refrigerant being distributed on the outer surface of the pipes for the purpose of effecting the heat transfer function.

One approach for distributing the refrigerant to the outer surface of the pipe bundle is that of a falling film evaporator wherein the liquid refrigerant is sprayed horizontally by a sprayer so that it contacts the outside of the pipe bundle. The refrigerant then flows by gravity from the top horizontal pipes to the bottom horizontal pipes, while cooling the liquid flowing within the pipes during the process.

One problem with such an approach is that the sprayed liquid refrigerant tends to splash off the surface of the pipes to thereby reduce the intimacy of contact between the refrigerant and heat exchange surface. Further, it is difficult to control the axial distribution of liquid refrigerant along the length of the tubes. This is especially true when considering that, as the liquid refrigerant is discharged from the expansion valve, a portion of it will be in a liquid/vapor (two-phase) state, and as the refrigerant flow depletes as a result of being distributed through a perforated pipe or the like, the flow pattern in the distribution conduit can become stratified. The result is a maldistrubtion of refrigerant over the heat exchanger pipes.

One common approach to solving the problem is to use a liquid-vapor separator to separate the liquid and vapor phases coming from the expansion valve. This can be accomplished by either an internal or external liquid-vapor separator. However, in either case such an addition represents a substantial increase in cost, weight and manufacturing complexity.

It is therefore an object of the present invention to provide an improved method and apparatus for refrigerant distribution in a falling film evaporator.

Another object of the present invention is the provision for effectively distributing two-phase refrigerant in a falling film evaporator.

Yet another object of the present invention is the provision for an improved method and apparatus for distributing two-phase flow in a uniform manner over the heat transfer tubes of an evaporator.

Still another object of the present invention is the provision for a falling film evaporator that is economical to manufacture and effective and efficient in use.

These objects and other features and advantages become readily apparent upon reference to the following descriptions when taken in conjunction with appended drawings.

SUMMARY OF THE INVENTION

Briefly, in accordance with one aspect of the invention, a header which receives two-phase refrigerant from the expansion valve is provided with a nozzle which provides a pressure drop and an increase in velocity to propel the two-phase refrigerant flow into the header. The structure of the header thus provides a closed circuit such that the refrigerant makes a complete cycle through the header to return to the nozzle. In this way, the nozzle provides for a continuous flow of the two-phase refrigerant mixture through the header to thereby ensure a uniform distribution to the individual subheaders that are fluidly interconnected to the header.

By yet another aspect of the invention, the header is a two-pass structure interconnected by a return bend, with the first pass having openings that are fluidly connected to subheaders, and the second pass is simply provided to return the flow from the return bend to the nozzle at the other, upstream, end of the first pass.

In accordance with another aspect of the invention, there are provided a plurality of subheaders with each having a similar structure as that of the header, including nozzle, a first pass, a return bend and a second pass. In addition, the first pass has at its lower surface, a plurality of opening through which liquid refrigerant can flow downwardly to engage the upper surface of the second pass. The refrigerant then is uniformly distributed over the upper surface of the second pass, running down over the sides and is then uniformly distributed over the heat transfer tubes below.

In the drawings as hereinafter described, a preferred embodiment is depicted; however various other modifications and alternate constructions can be made thereto without departing from the true spirt and scope of the invention.

DETAILED DESCRIPTION OF THE INVENTION

Figure 1:
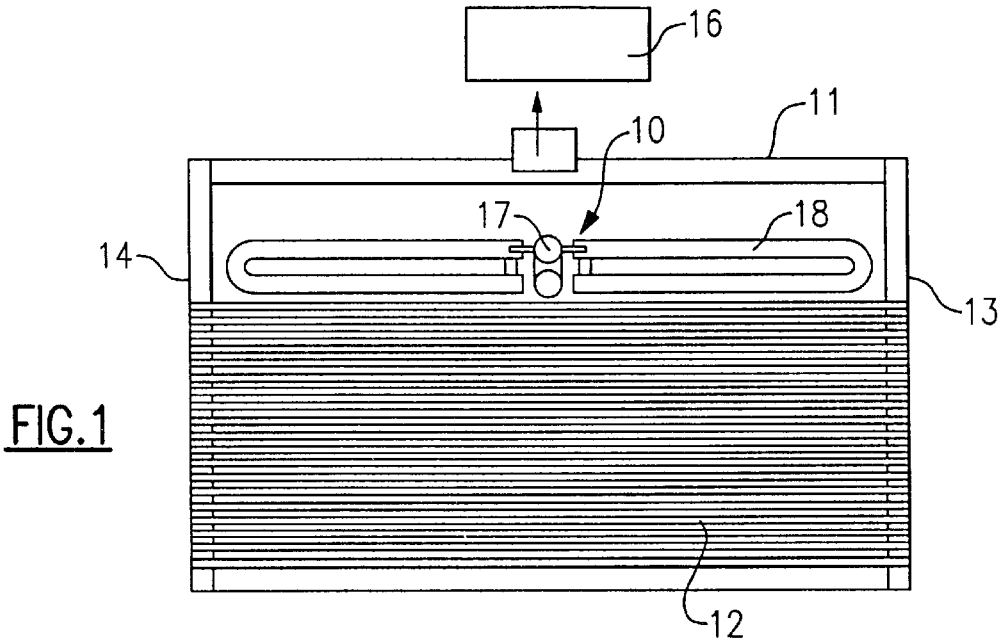
FIG. 1 is a sectional elevational view of an evaporator with the present invention incorporated therein

Referring to FIG. 1, the invention is shown generally at 10 as applied to an evaporator 11. The plurality of heat transfer tubes 12 are supported at their ends by tube sheets 13 and 14 as shown. Heat transfer tubes 12 are fluidly interconnected to a distribution system for the circulation of cooled water to various locations in a conventional manner. Compressor 16 is fluidly attached to the top of the evaporator 11 to pump the refrigerant vapors from the evaporator 11 for circulation within the system in a conventional manner.

In accordance with the present invention, a header 17 is located above the heat transfer tubes 12 and is generally aligned perpendicularly to the axes of the heat transfer tubes 12 as shown. Fluidly connected to, and extending normally from (i.e. parallel to the axes of the heat transfer tubes 12) are a plurality of subheaders 18, with half extending in one direction and covering substantially half the length of the heat transfer tubes 12 and the other half extending in the opposite direction and covering the other half of the heat transfer tubes 12. The structure of the header 18 is shown in greater detail in FIG. 2, and the structure of the subheaders is shown in greater detail in FIG. 3.

Figure 2:
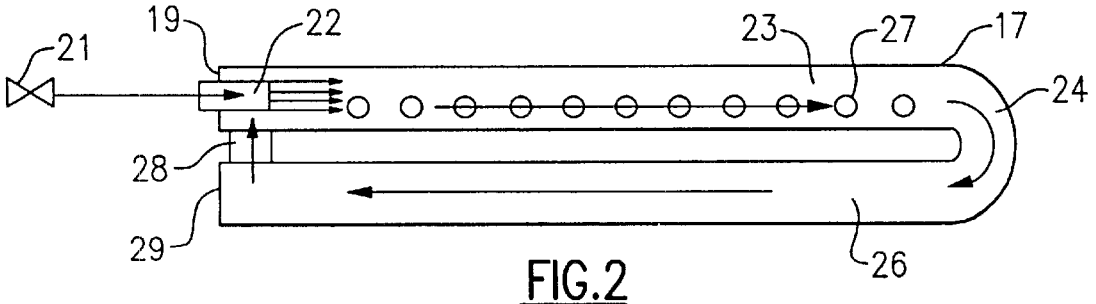
FIG. 2 is a schematic illustration of an evaporator header in accordance with the present invention.

As will be seen in FIG. 2, the header 17 is connected at its upstream end 19 to an expansion valve 21. Just inside the header upstream end 19 is a nozzle 22 which acts to provide a pressure drop and a velocity increase to the refrigerant flow into the header 17 such that it acts as a jet nozzle to propel the refrigerant through the header 17. It also assists in maintaining a continuous circular flow of refrigerant around the header 17 as will be more fully described hereinafter. The header 17 is comprised of a first pass conduit 23, a second pass conduit 26 disposed parallel thereto, and a return bend 24 which fluidly interconnects the two at their ends as shown. Disposed in the first pass conduit 23 is a plurality of openings or outlets 27 which fluidly lead to the plurality of subheaders 18. It is desirable that the two-phase refrigerant flow coming into the upstream end 19 of the first pass conduit 26 be uniformly distributed to the various outlets 27 so that the various subheaders all receive substantially the same amount of two-phase refrigerant flow at the same condition. This is accomplished, in part, by providing for proper circulation of the flow within the header 17 as shown by the arrows. Circulation is enhanced by the completion of the circuit by way of a crossover conduit 28 between the downstream end 29 of the second pass conduit 26 and the nozzle 22 as shown. Thus, because of the momentum of the two-phase flow as caused by the nozzle 22, the jet pump effect draws the refrigerant from the downstream end 29 of the second pass conduit 26 and causes it to reenter the flow stream in the first pass conduit 23. This circular flow pattern thus helps to maintain a relatively uniform mixture of vapor/liquid refrigerant so as to ensure an uniform distribution to the subheaders 18.

Figure 3:
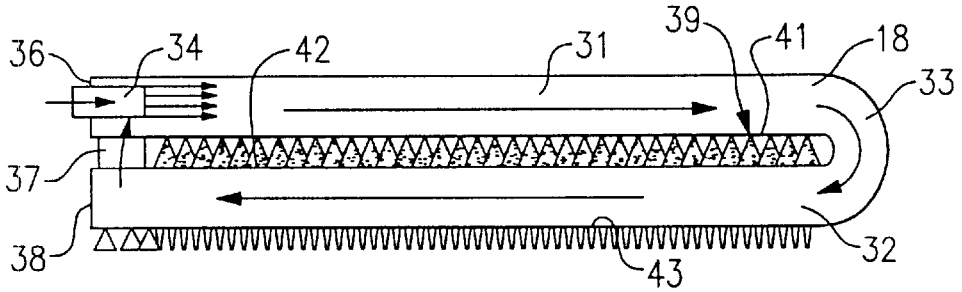
FIG. 3 is a schematic illustration of a subheader in accordance with a preferred embodiment of the invention.

Referring now to the subheaders 18 as shown in FIG. 3, the structure is similar to that of the header 17 in that a first pass conduit 31 is interconnected to a second conduit 32 by way of a return bend 33. Further, a nozzle 34 is provided in the upstream end 36 of the first pass conduit and a crossover conduit 37 is provided to fluidly interconnect the downstream end 38 of the second pass conduit 32 to the nozzle 34. Thus, the circulation of the two-phase refrigerant around the subheader 18 as shown by the arrows enhances the uniform distribution of vapor/refrigerant within the subheader 18.

However, rather then the plurality of outlets 27 as shown in the header 17, the subheaders 18 have a plurality of openings 39 in the lower wall 41 of the first pass conduit 31 as shown. Openings 39 allow for the downward passage of two-phase refrigerant from the first pass conduit 31 such that the dispensed refrigerant falls on the upper wall 42 of the second pass conduit 32. This facilitates the axially spreading and uniform distribution of the refrigerant as it passes over the sides of the second pass conduit 32 and falls off the bottom wall 43 to the heat transfer tubes below. In this way, a uniform distribution of refrigerant over the heat transfer tubes 12 results.

While the present invention has been particularly shown and described with reference to a preferred embodiment as illustrated in the drawings, it will be understood by one skilled in the art that various changes in detail may be effected therein without departing from the spirit and scope of the invention as defined by the claims.

I claim:

1. A falling film evaporator for receiving two-phase refrigerant flow from an expansion valve and delivering refrigerant vapor to a compressor comprising:

a plurality of heat transfer tubes supported by tube sheets and adapted to conduct the flow of liquid to be cooled therein;

a header disposed vertically above said heat transfer tubes for receiving two-phase refrigerant flow from the expansion valve and conducting the flow of two-phase refrigerant therethough;

and a plurality of subheaders disposed vertically over said heat transfer tubes for receiving two-phase refrigerant flow from said header;

wherein said header comprises an inlet for receiving two-phase refrigerant flow from said expansion valve;

a first pass conduit for receiving refrigerant from said inlet and further conducting said flow to a return bend for reversal of refrigerant flow direction; and a second pass conduit disposed vertically under said first pass conduit for internally receiving refrigerant flow from said return bend and further wherein said first pass conduit has a plurality of outlet openings formed therein for conducting the flow of refrigerant from said first pass to said plurality of subheaders.

2. A falling film evaporator as set forth in claim 1 wherein said header inlet includes a nozzle for increasing the velocity of said refrigerant flow into said first pass.

3. A falling film evaporator as set forth in claim 2 and including a conduit interconnecting a downstream end of said second pass conduit to an upstream end of said first pass conduit.

4. A falling film evaporator as set forth in claim 1 wherein said plurality of subheaders each comprises:

an inlet for receiving two-phase refrigerant flow from a header outlet;

a first pass conduit for receiving refrigerant from said inlet and further conducting said flow to a return bend for reversal of refrigerant flow direction, said first pass conduit having in a lower surface thereof a plurality of openings formed therein for conducting the flow of refrigerant downwardly;

a second pass conduit disposed vertically under said first pass conduit for internally receiving refrigerant from said return bend and for externally receiving, on an upper surface thereof, refrigerant flow from said plurality of openings, with the refrigerant then flowing over an outer surface of said second pass conduit to said heat transfer tubes below.

5. A falling film evaporator as set forth in claim 4 wherein at least one of said subheader inlets includes a nozzle for increasing the velocity of said refrigerant flowing into said subheader.

6. A falling film evaporator as set forth in claim 5 and including a conduit interconnecting a downstream end of said subheader second pass conduit to an upstream end of said subheader first pass conduit.

7. A falling film evaporator as set forth in claim 6 wherein said interconnecting conduit is fluidly connected to said nozzle.

8. A falling film evaporator for receiving two-phase refrigerant flow from an expansion valve and delivering refrigerant vapor to a compressor, comprising:

a plurality of heat transfer tubes supported by tube sheets and adapted to conduct the flow of liquid to be cooled therein;

a header disposed vertically above said heat transfer tubes for receiving two-phase refrigerant flow from an expansion valve and conducting the flow to plurality of header outlets;

and a plurality of subheaders disposed vertically above said heat transfer tubes, each of said subheaders comprising:

an inlet for receiving two-phase refrigerant flow from a header outlet;

a first pass conduit for receiving refrigerant from said inlet and further conducting said flow to a return bend for reversal of refrigerant flow direction, said first pass conduit having in a lower surface thereof a plurality of openings formed therein for conducting the flow of refrigerant downwardly;

a second pass conduit disposed vertically under said first pass conduit for internally receiving refrigerant from said return bend and for externally receiving, on an upper surface thereof, refrigerant flow from said plurality of openings, with the refrigerant then flowing over an outer surface of said second pass conduit to said heat transfer tubes below.

9. A falling film evaporator as set forth in claim 8 wherein at least one of said subheader inlets includes a nozzle for increasing the velocity of said refrigerant flowing into said subheader.

10. A falling film evaporator as set forth in claim 9 and including a conduit interconnecting a downstream end of said subheader second pass conduit to an upstream end of said subheader first pass conduit.

11. A falling film evaporator as set forth in claim 10 wherein said interconnecting conduit is fluidly connected to said nozzle.

12. A method of distributing two-phase refrigerant flow to a plurality of heat transfer tubes in an evaporator, comprising the steps of:

providing a header in a vertical disposition above the heat transfer tubes for receiving two-phase refrigerant flow from an expansion valve said header having first and second pass conduits, providing a nozzle in an inlet of said header for propelling refrigerant flow from said inlet through said first and second pass conduits; and providing for the flow of two-phase refrigerant flow from said first pass conduit to a plurality of subheaders and for further distribution to said heat transfer tubes.

13. A method as set forth in claim 12 wherein said two-phase refrigerant is distributed from said plurality of subheaders to said heat transfer tubes by way of a falling film process.

14. A method as set forth in claim 12 and including in the step of providing at an inlet of each subheader, the step of providing a nozzle for propelling two-phase refrigerant flow from said inlet through first and second pass conduits of said subheader.

15. A method as set forth in claim 14 and including the further step of providing a crossover conduit to fluidly interconnect a downstream end of said subheader second pass conduit to an upstream end of said subheader first pass conduit.

16. A method as set forth in claim 15 wherein said step of distributing refrigerant from said subheaders to said heat transfer tubes is by way of openings in the bottom surface of said subheader first pass conduits.

17. A method as set forth in claim 16 and including the further step of providing for the flow of refrigerant from said plurality of openings to an upper surface of said subheader second pass conduits, and then to said heat transfer tubes.

* * * * *